US006205997B1

(12) United States Patent
Bartley

(10) Patent No.: US 6,205,997 B1
(45) Date of Patent: Mar. 27, 2001

(54) OVEN RACK

(76) Inventor: Robert J. Bartley, 810 Swan La., Stevensville, MT (US) 59870

( * ) Notice: Subject to any disclaimer, the term of this patent is extended or adjusted under 35 U.S.C. 154(b) by 0 days.

(21) Appl. No.: 09/567,662

(22) Filed: May 9, 2000

(51) Int. Cl.[7] ..... F24C 15/16

(52) U.S. Cl. ..... 126/337 R; 126/339; 211/181.1; 211/153

(58) Field of Search ..... 126/337 R, 332, 126/338, 339, 337 A, 333; 211/181.1, 153, 134; 312/280, 281, 351

(56) References Cited

U.S. PATENT DOCUMENTS

| | | | | |
|---|---|---|---|---|
| 737,671 | * | 9/1903 | Spicer | 126/332 |
| 1,398,725 | * | 11/1921 | Kneier | 126/337 R |
| 1,445,459 | * | 2/1923 | Streda | 126/332 |
| 1,941,301 | | 12/1933 | Hanson et al. | 126/339 |
| 1,997,432 | * | 4/1935 | Replogle | 126/337 R |
| 2,189,240 | * | 2/1940 | Burr | 126/337 R |
| 2,751,486 | * | 6/1956 | Evans | 126/337 R |
| 2,806,467 | | 9/1957 | Slaughter | 126/337 R |
| 3,450,025 | * | 6/1969 | Fleming | 126/337 R |
| 4,476,848 | * | 10/1984 | Protas | 126/337 R |
| 5,938,968 | | 8/1999 | Ogg et al. | 126/339 |

FOREIGN PATENT DOCUMENTS

| | | | |
|---|---|---|---|
| 15228 | * | 10/1915 | (GB) . |
| 10-238964 | * | 9/1998 | (JP) . |

* cited by examiner

*Primary Examiner*—Ira S. Lazarus
*Assistant Examiner*—Josiah C. Cocks
(74) *Attorney, Agent, or Firm*—Saliwanchik, Lloyd & Saliwanchik

(57) ABSTRACT

An oven rack has a notch along its periphery. Flat items placed on the rack traversing the notch can be easily removed from the oven without having to first slide the rack from the oven.

7 Claims, 5 Drawing Sheets

OVEN RACK

BACKGROUND OF THE INVENTION

The convenience of free delivery often makes ordering a pizza a more attractive alternative than making one at home. The availability of gourmet and professional equipment, such as pizza stones, however have made preparing an authentic pizzeria-style pizza at home a possibility. A pizza stone cooks the pizza evenly providing a continuous source of heat and the stone absorbs moisture to provide a crispy crust.

Pizza stones are flat having no lip or edge to grab when removing the stone from the oven. Thus, in order to remove a stone, or any other flat item, from an oven, it is necessary to pull the rack out of the oven, reach behind the stone and push the edge of the stone over the lip of the oven rack, and then push the rack back into the oven before grabbing the stone. When the rack is pulled out of the oven, it is only partially supported and can tilt either falling from the oven or dumping its hot contents onto the floor. Additional safety concerns arise when, at home, children and animals are underfoot.

Oven shelves have been designed to address a number of problems encountered in cooking and baking in an oven. For example, Ogg et al. (U.S. Pat. No. 5,938,968) describe a retractable shelf for a microwave oven to assist the cook in accessing foods which have to be turned or stirred while cooking. Slaughter (U.S. Pat. No. 2,806,467) describes an oven shelf with an insulated handle so the rack can be removed without donning an oven mitt. Hanson etal. (U.S. Pat. No. 1,941,301) describe a tray holder which facilitates withdrawal of a tray from the oven and allows the raising an lowering of that tray within the oven. Each of these racks, although useful for its intended purpose, do not address the problem of removing flat items safely from an oven rack.

SUMMARY OF THE INVENTION

The invention is an oven rack which has a notch along its peripheral surface. Items placed into the oven, on the rack, with an edge extending over that notch can be easily removed from the oven without having to slide the rack out of the oven. In a preferred embodiment, this notch is placed on the front ofthe rack toward the door, near the center and is approximately 4½ inches wide by 4½ inches deep allowing adequate room for a hand covered by an oven mitt to reach into the notch and access items on the rack.

DETAILED DESCRIPTION OF THE INVENTION

The oven rack of the subject invention has a notch along its periphery. The notch allows flat items to be removed from the oven without having to pull the rack from the oven.

Figure 1A:
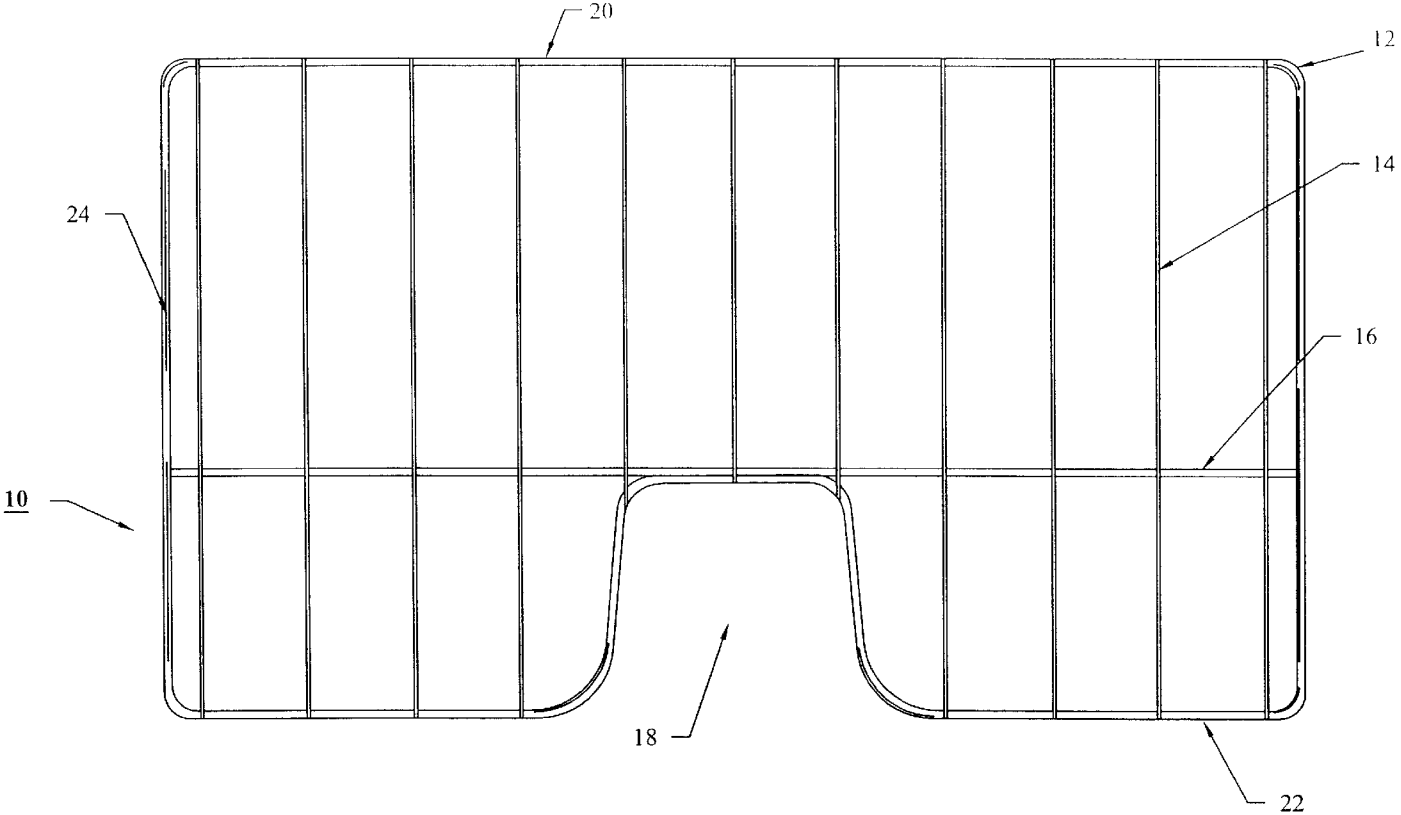
FIG. 1A is a top plan view of a preferred embodiment of the oven rack of the subject invention.
Figure 1B:
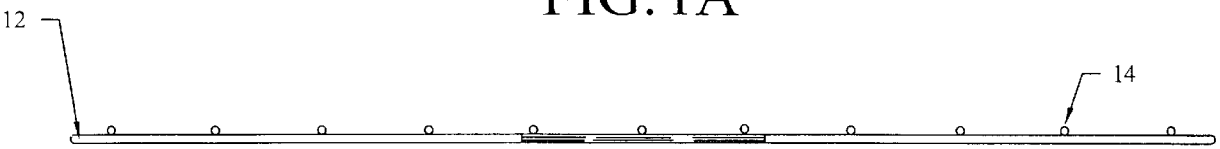
FIG. 1B is an elevational view of the tail edge of a preferred embodiment of the oven rack of the subject invention.
Figure 2A:
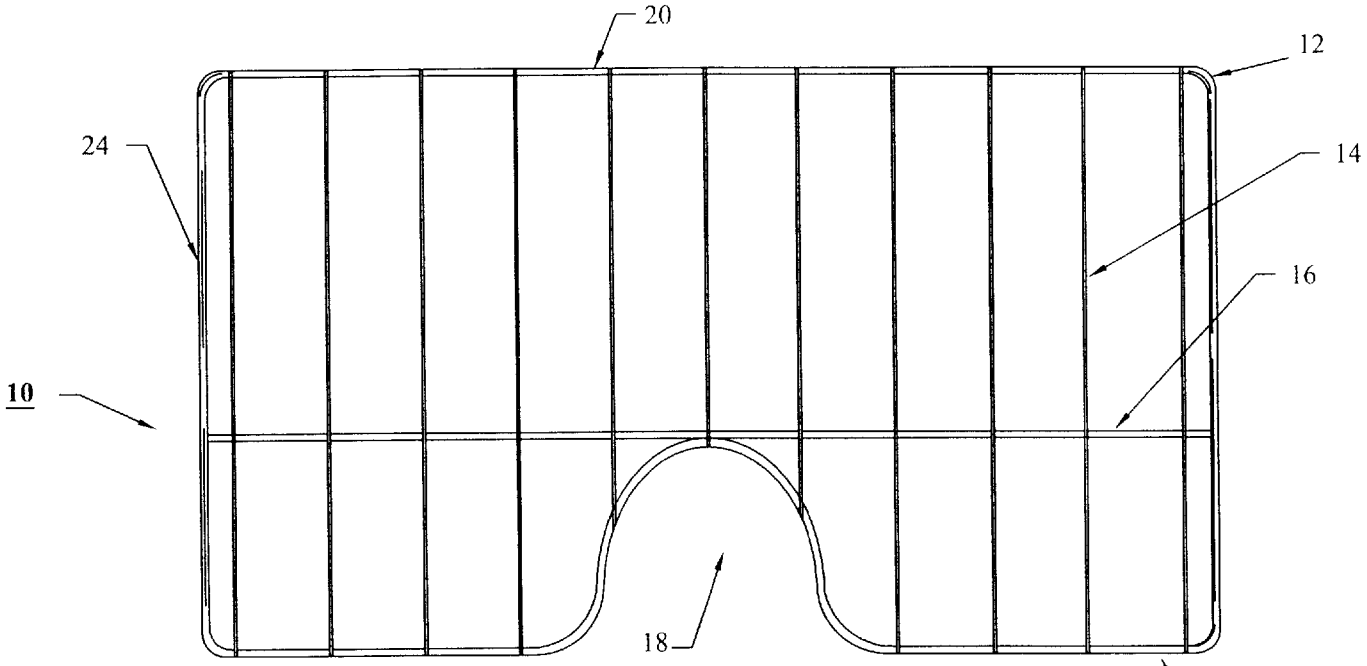
FIG. 2A is a top plan view of another preferred embodiment of the oven rack of the subject invention.
Figure 2B:
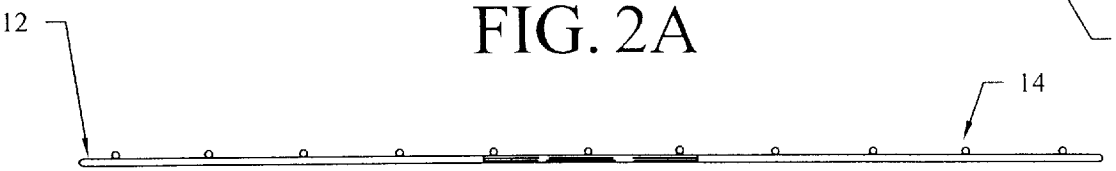
FIG. 2B is an elevational view of the tail edge of another preferred embodiment of the oven rack of the subject invention.
Figure 3A:
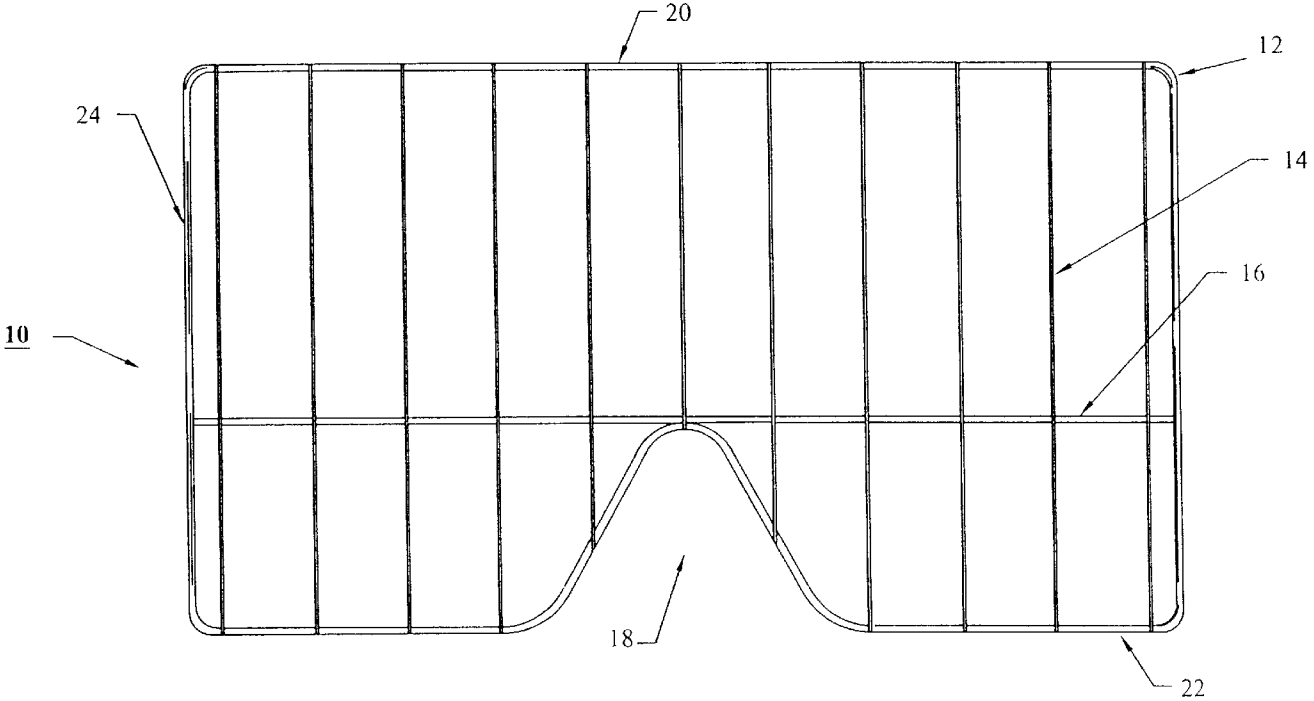
FIG. 3A is a top plan view of another preferred embodiment of the oven rack of the subject invention.
Figure 3B:
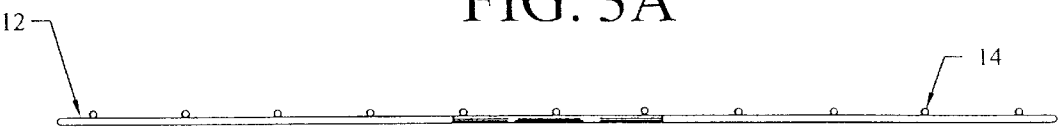
FIG. 3B is an elevational view of the tail edge of another preferred embodiment of the oven rack of the subject invention.

A preferred embodiment of the oven rack of the subject invention is shown generally at 10 in FIG. 1A. The rack is defined by a frame 12 supporting a plurality of bars 14 and a cross-member 16. The frame 12 has a notch 18 in its periphery.

Figure 5:
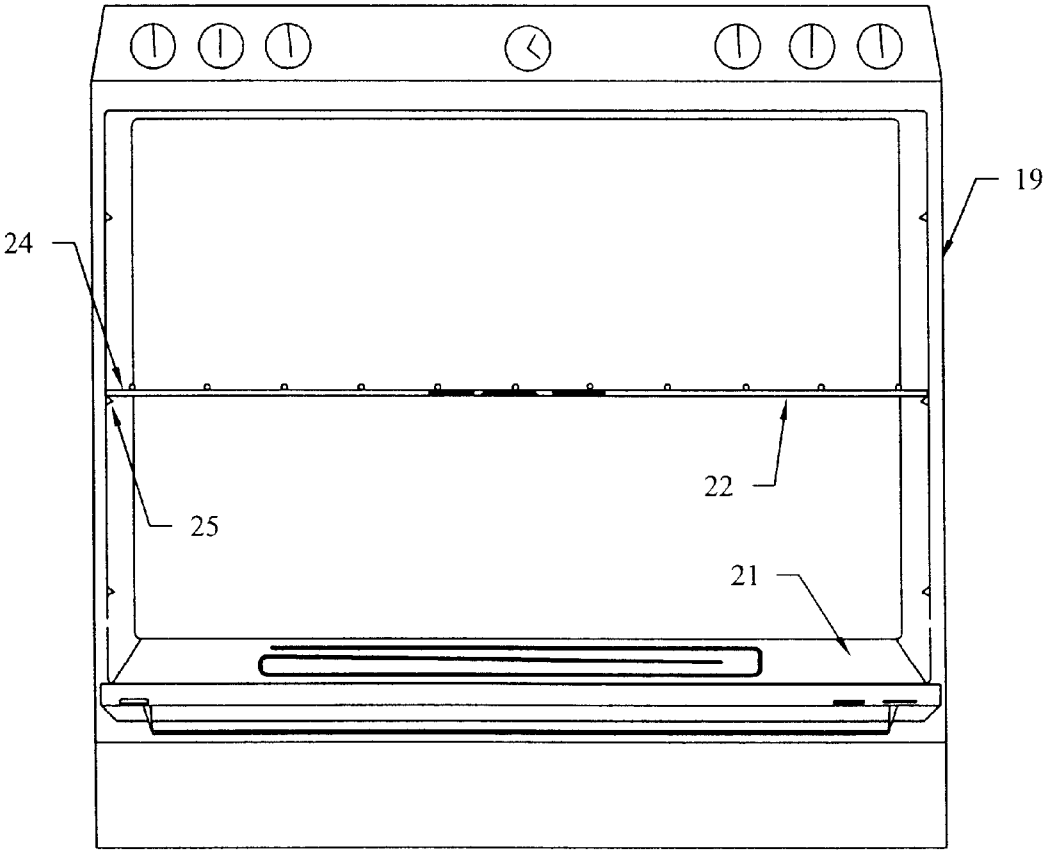
FIG. 5 is a front elevational view of an oven with a preferred embodiment ofthe oven rack of the subject invention in position in the oven.
Figures 4A, 4B:
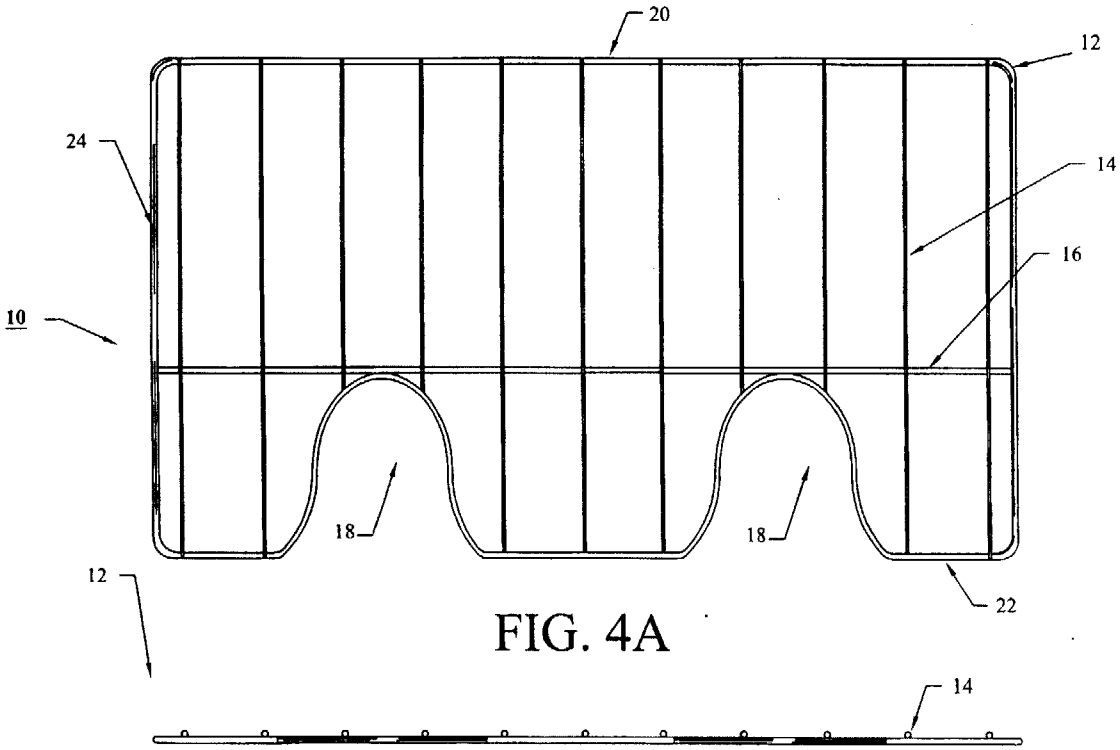

In the exemplified embodiment, the rack 10 of the subject invention is used in an oven 19 (FIG. 5). A conventional oven is a closed box having a top, bottom and four sides. A door 21 on one side of the box accesses the oven. In place in the oven, the rack of the subject invention has a leading edge 20, tail edge 22, and two side edges 24. The rack is supported in the oven by the sides 24 which engage tracks 25 usually integrally formed from the oven wall. The leading edge 20 slides into the oven and rests against the side opposite the door. The tail edge 22 of the rack faces the oven door.

The frame and bars of the rack of the exemplified embodiment are made from steel which provides adequate strength to support items such as cake pans, pizza stones and casseroles and withstands the heat of an oven. The frame 12 was created by bending a ¼ inch steel bar. Steel bars (⅛ inch) were cut to size and spot welded on the frame as bars 14.

The rack of the subject invention can be used in settings other than in an oven. For example, the rack of the subject invention could be used in a freezer unit. Materials suitable for constructing a rack to be used in a freezer unit could include plastic coated wire. The materials from which the racks are constructed must be appropriate for the intended use of the rack and possess the desired supporting strength. These suitable materials can include, but are not limited to, plastics, other metals, such as aluminum, or organic materials. It is important to note, the frame 12, the bars 14 and the cross-member 16 need not be constructed from the same materials.

The size of the frame 12 of the rack of the subject invention also depends upon the intended use of the rack. In the exemplified embodiment, the rack is sized to slide into or replace a rack in a conventional oven. Likewise, the bars 14 are spaced to accommodate cookware. The frame can be made larger to fit commercial ovens or sized to fit any apparatus in which the racks are to be used. The bars of the rack can be spaced appropriately within the frame to hold any designated items.

In a particularly preferred embodiment, the rack of the subject invention has a cross-member 16. The cross-member can provide extra support for the rack. The notch 18 sometimes allows the rack to flex and twist. The cross-member 16 stabilizes this flex adding strength to the rack.

In the exemplified embodiment, the notch 18 is on the tail edge 22 near the center of the rack. In this embodiment, the notch 18 measures from about 3 inches wide to about 7 inches wide and from about 3 inches deep to about 7 inches deep. Most preferably, the notch is about 4½ inches wide by 4½ inches deep. This allows adequate space for a protected hand to grab an item from the rack. A large notch could allow more than one item to be accessed through the notch. The notch can be any shape. The notch in the rack of the exemplified embodiment is square, equal in length and width. The notch in the rack could be, for example, a half-circle or elliptical. Further, the notch could be rectangular, unequal in length and width. Additionally, the notch 18 need not be placed near the center of the rack, nor does there need to be a single notch per rack. A notch placed nearer the side of the rack, and the side of the oven, still allows items which span the notch to be removed without sliding the rack from the oven. Further, a rack for a specialized oven, for example a pizza oven, could have two or more notches along its periphery so a number of pizza stones could be placed in the oven. The size and placement of the notch does not effect the use of the rack for standard baking or cooking. Heavy roasters or cake pans are fully supported by the rack of the subject invention. The rack can be pulled from the oven should the cook wish to check cooking progress just as on a regular oven rack. In fact, the notch in the rack of the subject invention allows a cook to place a hand firmly under a heavy item while lifting it from the oven. The heavy item is better supported upon removal from the oven which is safer for the cook and others in the kitchen.

The rack of the subject invention is safer than a regular oven rack when removing flat items from the oven. To remove a flat item from a regular oven rack, it is necessary to pull the rack partially out of the oven and reach behind the item to push the edge of the item over the lip of the rack. The rack is usually then slid back into the oven and the flat item is removed from the rack. This practice is unsafe because the partially removed rack is not fully supported and can tip falling from the oven or dumping hot food items. Further, the oven is left open for a period of time during this process leaving its hot surfaces accessible to small children. When a flat item is placed on the rack of the subject invention, traversing the notch, the item can be easily and safely removed by grabbing its edge in the notch.

Additionally, the rack of the subject invention provides access to items on the bottom rack without the fear of being burned. Little room is left between the top and bottom racks to grab the lip of a pan on the bottom rack. A cook can burn a hand or wrist on the upper rack while reaching past the rack to access items on the lower rack. The rack of the subject invention provides access to items on the lower rack through the notch preventing possible burns. Likewise, the rack of the subject invention can prevent "burning" when reaching into an ultra-cold (−20° C.) freezer.

Further, the rack of the subject invention requires that the oven be open only a short period of time. It is not necessary to partially remove the subject rack to adjust the cookware sitting on it when attempting to remove items from the oven. A flat item is easily removed by grabbing the edge of the item which transverses the notch. Thus, the oven door is open only briefly saving energy and assuring a more constant cooking temperature.

It should be understood that the examples and embodiments described herein are for illustrative purposes only and that various modifications or changes in light thereof will be suggested to persons skilled in the art and are to be included within the spirit and purview of this application.

What is claimed is:

1. A rack for an oven, said rack comprising a frame supporting a plurality of bars, said frame having a periphery with at least one notch, said notch measuring from about 3 inches wide to about 7 inches wide and from about 3 inches deep to about 7 inches deep allowing adequate room to receive a protected hand of a user, said notch facing, door of said oven, and said notch near the center of said rack, wherein a flat item having an edge spanning said notch can be removed from said rack without having to pull said rack from said oven.

2. The rack of claim 1, wherein said notch is about 4½ inches wide by about 4½ inches deep.

3. The rack of claim 1, wherein said notch is semi-circular.

4. The rack of claim 1, wherein said notch is elliptical.

5. The rack of claim 1, comprising at least two notches.

6. The rack of claim 1, wherein said oven comprises a top, a bottom and four sides, at least one of said sides has a door, said frame comprises a leading edge, a tail edge and side edges and said notch faces said door.

7. The rack of claim 6, wherein said side edges of said frame engage two of said sides of said oven and said leading edge of said frame engages another side of said oven and said notch is on said tail edge of said rack facing said door.

* * * * *

UNITED STATES PATENT AND TRADEMARK OFFICE

CERTIFICATE OF CORRECTION

Figure 4A:
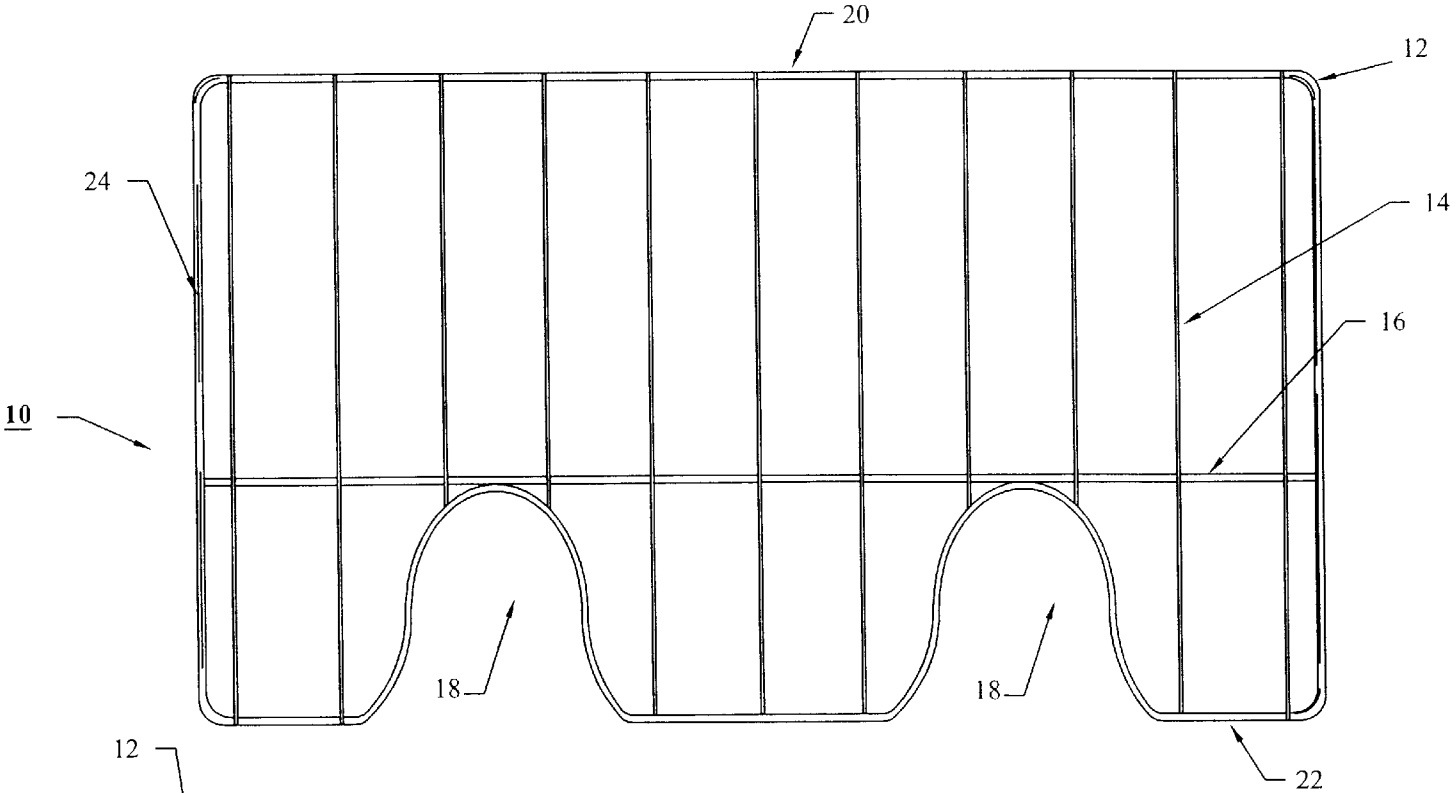
FIG. 4A is a top plan view of another preferred embodiment of the oven rack of the subject invention.
Figure 4B:
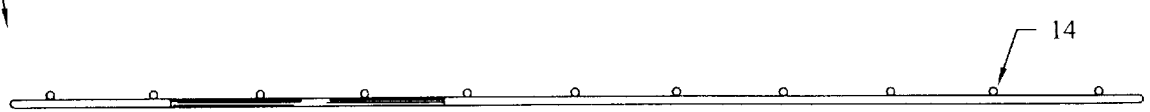
FIG. 4B is an elevational view of the tail edge of another preferred embodiment ofthe oven rack of the subject invention.

PATENT NO. : 6,205,997 B1
DATED : March 27, 2001
INVENTOR(S) : Robert J. Bartley It is certified that error appears in the above-identified patent and that said Letters Patent is hereby corrected as shown below:

Drawings,
Sheet 4, Figure 4B,
Figures 4A and 4B should be replaced by corrected Figures 4A and 4B.

Signed and Sealed this

Fifth Day of March, 2002

*Attest:*

*Attesting Officer*

JAMES E. ROGAN
*Director of the United States Patent and Trademark Office*